US006384729B1

(12) United States Patent
Plotkin

(10) Patent No.: US 6,384,729 B1
(45) Date of Patent: May 7, 2002

(54) BIOFEEDBACK EXERCISE STIMULATION APPARATUS

(76) Inventor: Irwin Plotkin, 232 Round Hill Rd., East Hills, NY (US) 11577

( * ) Notice: Subject to any disclaimer, the term of this patent is extended or adjusted under 35 U.S.C. 154(b) by 0 days.

(21) Appl. No.: 09/703,579

(22) Filed: Nov. 1, 2000

Related U.S. Application Data

(60) Provisional application No. 60/162,817, filed on Nov. 1, 1999.

(51) Int. Cl.[7] ..... G08B 23/00

(52) U.S. Cl. ..... 340/573.1; 340/573.7

(58) Field of Search ..... 340/573.1, 573.4, 340/573.7, 575; 600/592, 594, 595, 545, 546

(56) References Cited

U.S. PATENT DOCUMENTS

| | | | | | |
|---|---|---|---|---|---|
| 3,608,541 | A | | 9/1971 | Hall | 340/573.1 |
| 3,670,302 | A | | 6/1972 | Palmer | 340/573.7 |
| 4,170,225 | A | * | 10/1979 | Criglar et al. | 600/546 |
| 4,227,189 | A | | 10/1980 | Davis | 340/573.1 |
| 4,300,129 | A | | 11/1981 | Cataldo | 340/539 |
| 4,750,480 | A | | 6/1988 | Jenness | 340/668 |
| 4,846,462 | A | | 7/1989 | Regnier et al. | 340/573.7 |
| 4,871,998 | A | | 10/1989 | Chaillou | 340/573.7 |
| 4,914,423 | A | | 4/1990 | Fernandez | 340/573.4 |
| 5,168,264 | A | | 12/1992 | Agustin | 340/573.7 |
| 5,304,984 | A | | 4/1994 | Roldan | 340/573.7 |
| 5,398,019 | A | | 3/1995 | Barnett et al. | 340/573.7 |
| 5,728,027 | A | * | 3/1998 | Sinaiko | 340/573.1 |
| 5,749,838 | A | | 5/1998 | Kline | 340/573.7 |
| 5,808,540 | A | | 9/1998 | Wheeler et al. | 338/114 |
| 5,823,913 | A | | 10/1998 | Aruin et al. | 340/573.1 |
| 5,857,984 | A | | 1/1999 | deBoer et al. | 340/573.1 |
| 5,877,687 | A | | 3/1999 | Bernard et al. | 340/573.7 |
| 6,057,767 | A | * | 5/2000 | Barnoach | 340/575 |
| 6,146,312 | A | * | 11/2000 | Sclichter | 340/573.1 |
| 6,265,978 | B1 | * | 7/2001 | Atlas | 340/575 |

* cited by examiner

*Primary Examiner*—Van Trieu
(74) *Attorney, Agent, or Firm*—Dilworth & Barrese, LLP

(57) ABSTRACT

A biofeedback exercise stimulation apparatus for sensing the state of the abdominal muscles and providing feedback signals to a user when the user relaxes the contraction of their abdominal muscles. The housing of the apparatus is configured to be readily inserted inside a waistband of the user and is self-retaining when positioned behind the waistband. The apparatus has a back side for positioning against the user and a front side with the self-retaining configuration. A sensor mechanism is positioned in proximity to the self-retaining configuration that detects the increased pressure between the user and the waistband when the user relaxes their abdominal muscles. The sensor mechanism is connected with a signal mechanism for the sending of a feedback signal, such as a light, sound, vibration, or electrical signal to the user that the abdominal muscles have been relaxed. The housing of the apparatus is configured to be readily slipped inside the waistband of the user and held in position by the shape of the housing. The apparatus can be configured to appear like a cellular telephone or beeper.

20 Claims, 4 Drawing Sheets

BIOFEEDBACK EXERCISE STIMULATION APPARATUS

CROSS-REFERENCE TO RELATED APPLICATIONS

The present application claims priority to U.S. provisional application serial No. 60/162,817 filed Nov. 1, 1999.

BACKGROUND

1. Technical Field

The present invention relates to an improved biofeedback exercise stimulation apparatus for exercising control over the abdominal muscles.

2. Description of Related Art

Bio-feedback apparatuses for the exercising of abdominal muscles are well-known devices which most commonly use specialized belts to position and retain relatively large mechanisms in a specific location relative to the user's abdomen. These devices typically provide some type of feedback signal to the user when they have relaxed their abdominal muscles. The bulk of these apparatuses generally make them inconvenient to use during normal daily activities.

In one such apparatus, namely U.S. Pat. No. 5,508,540 to Wheeler et al., a position sensing and signaling system is disclosed that is small enough that it can be attached to a user's belt, or in the alternative, near the waist line using a belt attachment mechanism that is comprised of a lever with a hook end. The outer case or housing of the Wheeler et al. system is a flat parallelpiped shape that also contains an external sense lever mechanism that is positioned in proximity with the user. Both the lever and the hook of the belt attachment mechanism and the sense lever mechanism are located on the rear of the housing. It is essential for the function of the Wheeler et al. sensing lever mechanism that the user place the device outside of the belt or garment in a position so that it will be able to fall freely away from an overhanging or pendulous abdomen. Thus, the Wheeler et al. apparatus senses the position of the abdominal muscles by having the sensor freely rotating on a horizontal hinge, but directly positioned next to the user. An increase in pressure between the user and the belt relative to the angle of the rotating sensor causes activation of the sensor.

While different sensing mechanisms are envisaged for the Wheeler et al. apparatus, the primary embodiment of Wheeler et al. uses the sense lever mechanism at the rear of the housing that is in close proximity to the body of the user. The sense lever mechanism is actuated by a variable resistive sponge device with a plurality of embedded electrodes that detects small changes in pressure at its attachment point on a belt or at the waist line in response to the relaxing of the user's abdominal muscles. When the sensing mechanism is activated it sends a signal that is used to provide a vibration or sound signal to the user.

Accordingly, a need exists for an improved biofeedback exercise stimulation apparatus which is lightweight, compact and self-supporting in the belt or waistband of the user.

SUMMARY

A biofeedback exercise stimulation apparatus for positioning inside a waistband of a person for indicating when the user has relaxed and expanded their abdominal muscles. The apparatus includes a housing having a front side configured and dimensioned to be self-retaining or self-supporting when inserted inside a waistband of a person. The apparatus further includes an upper section, a mid section, and a lower section. The upper section has a power source and at least one signal mechanism. Signal outputs envisioned include a multicolored light, vibration, sound, and a low voltage electrical stimulation. The mid section is configured and dimensioned to be retained in the waistband of the user and includes a sensor mechanism on the front side connected with the at least one signal mechanism. The sensor mechanism detects increased pressure between the body of the user and the waistband. The lower section has a streamlined shape configured for ease of insertion inside the waistband.

DETAILED DESCRIPTION OF THE PREFERRED EMBODIMENTS

Figure 1:
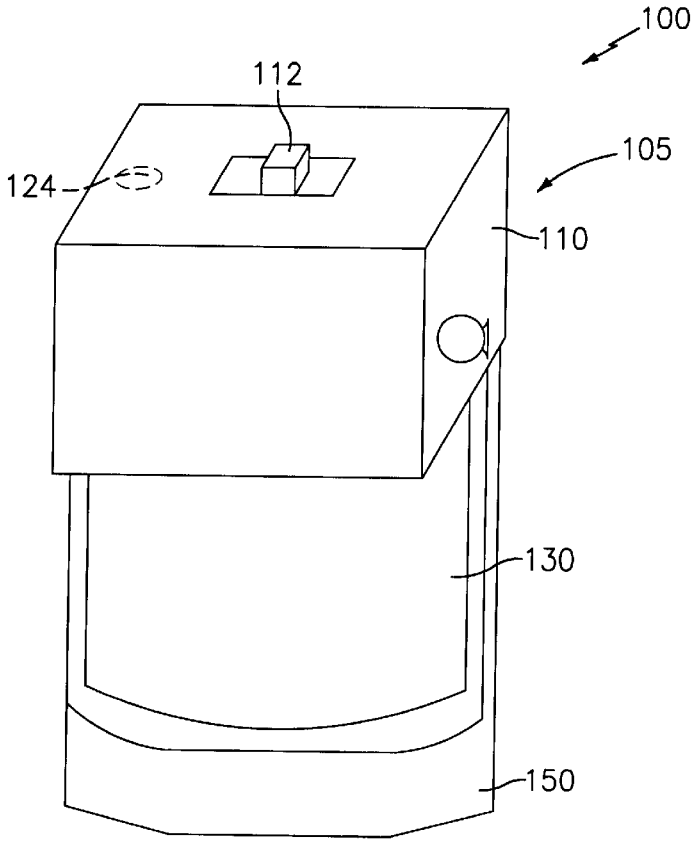
FIG. 1 is a perspective view of an illustrative embodiment of the biofeedback exercise stimulation apparatus constructed in accordance with the present disclosure.

Referring to the drawings in detail, and initially to FIG. 1, exercise stimulation apparatus 100 includes a housing 105 with an upper section 110, a mid section 130, and a lower section 150. Biofeedback exercise stimulation apparatus 100 is self-retaining and can be positioned anywhere inside a garment waistband or belt. The shape of biofeedback apparatus 100 is configured to be worn indiscretely in a daily work environment as well as during exercise sessions. When a user of bio-feedback stimulation apparatus 100 is no longer sufficiently contracting their abdominal muscles, a tactile switch 135 senses an increase in pressure and activates the selected signal mechanism to inform the user that they have relaxed their abdominal muscles. Feedback signal mechanisms are provided to the user in forms such as a low frequency vibration, audible beep, or a low level voltage stimulation. The bio-feedback exercise stimulation apparatus is approximately the size and shape of a communication beeper and in an alternative configuration can be integrated into a belt that would retain its fashionable qualities.

Housing 105 is preferably made of a molded plastic. A switch 112 and a sound tone device 124 are shown on the top side of upper housing section 110 in this configuration. Alternatively, however, they may be located on any other upper housing section 110 surface. Switch 112 could also be a low profile switch or recessed into upper section 110. The external dimensions and shape of exercise stimulation apparatus 100 approximates the shape of a communications beeper device. The small size of the exercise stimulation apparatus 100 makes it easy to wear or remove the device and when it is not being used it can be conveniently carried in a pocket or purse. This convenient usability makes it more likely that a user will use the device more often and for longer periods of time. Thus, the user will likely achieve desired results more rapidly.

Figure 2:
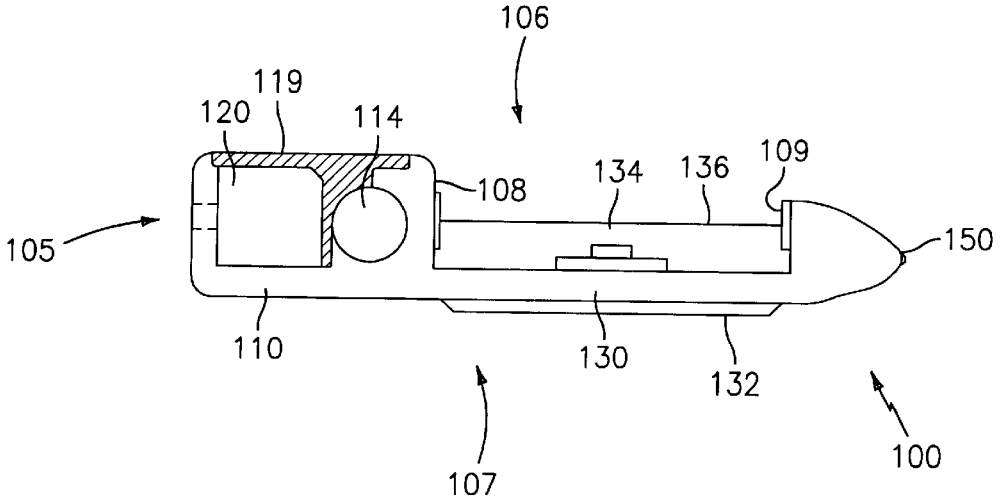
FIG. 2 is a side view of the biofeedback exercise stimulation apparatus.

In FIG. 2, housing 105 has a front 106 and a rear 107. Upper section 110 includes an electrical compartment 120 and an electrical compartment cover 119 which retain the electrical and mechanical devices that provide the signal to the user that exercise stimulation apparatus 100 has detected relaxation of their abdominal muscles. Compartment 120 also contains a space for a power source 114, such as a commercially available battery, e.g., a standard AAA type battery. A mid section 130 is dimensioned to form a U-shaped cavity between side 108 of upper section 110 and side 109 of lower section 150. The U-shaped cavity is configured for receiving a belt or waistband therein that will retain flexible rear cover 132 and a sensor mechanism such as a switch 134 in position against the body of the user. Once exercise stimulation apparatus 100 is positioned, any relaxation by the user of their abdominal muscles will increase the pressure upon switch 134 and initiate a signal to the user. Besides assisting in the self-retaining function through subsection 109, lower section 150 acts as a ballast for the retention of exercise stimulation apparatus 100 within the waistband or belt of the user. Lower section 150 has a streamlined shape to facilitate its comfortable placement inside the waistband of a garment or behind a belt.

Figure 3:
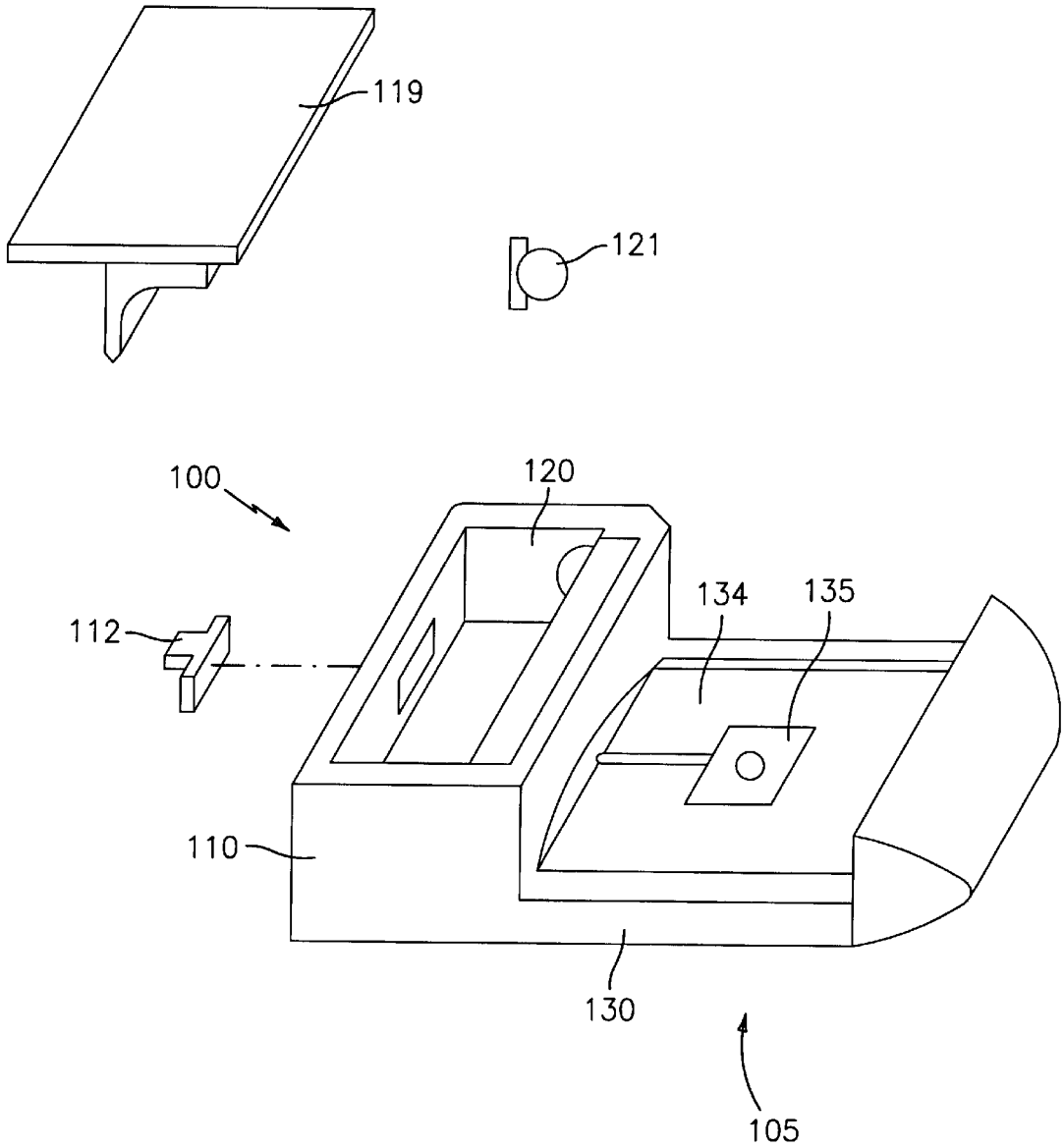
FIG. 3 is a partially exploded perspective view of the biofeedback exercise stimulation apparatus.

Referring now to FIG. 3, upper section 110 electrical compartment 120 is shown with electrical compartment cover 119 and battery cover 121. Housing 105 and subassemblies such as covers 121 and 119 are intended to be readily assembled using snaps or similar means. Switch 112 preferably has at least three positions which include OFF, ON-vibration, and ON-sound. Possible additional positions could include, for example, ON-light or an ON-electrical that provides a low powered electrical signal to the user when the device is activated. Mid section 130 contains switch 134 and a pressure sensing device such as tactile switch 135, that generates an electrical signal when it is compressed. Exercise stimulation apparatus 100 is self contained and is not expected to require maintenance other than the replacement or recharging of its battery.

Figure 4:
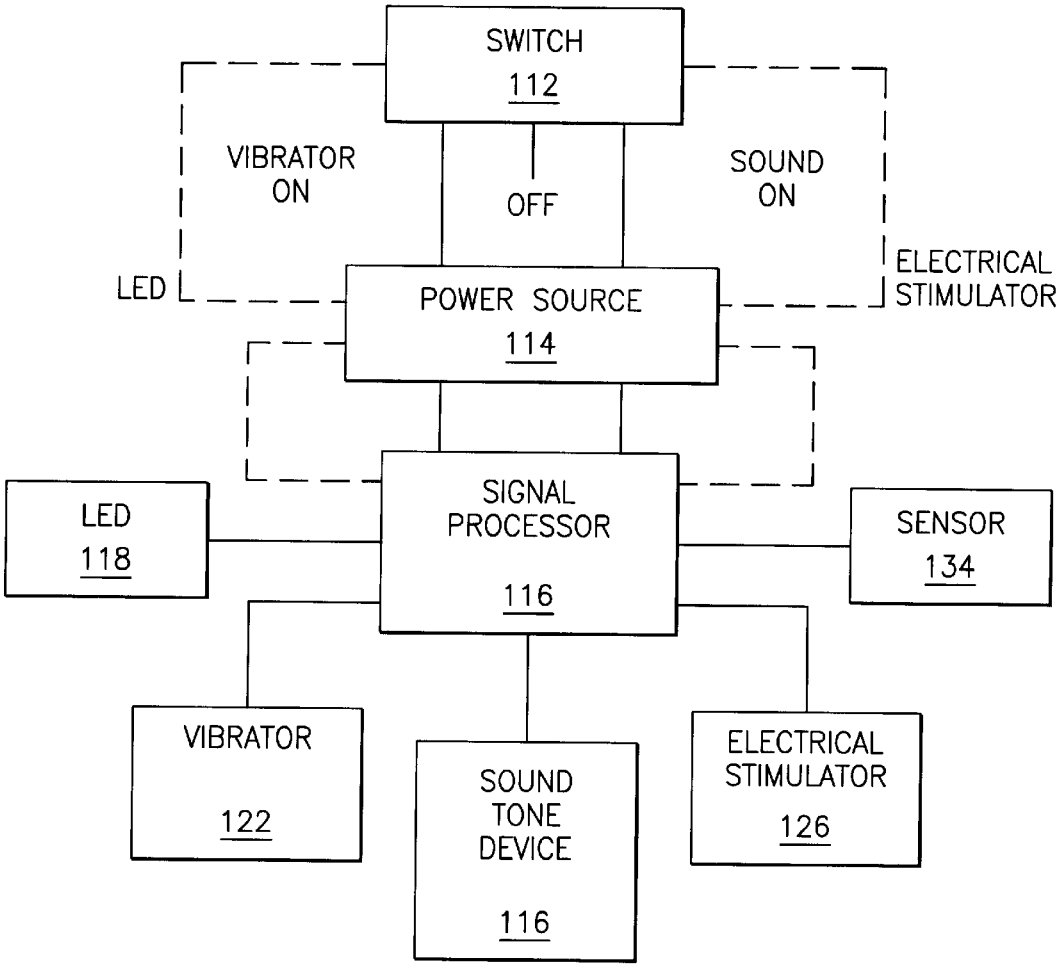
FIG. 4 is a block diagram of the circuitry of one configuration of the biofeedback exercise stimulation apparatus.

Referring now to FIG. 4, a block diagram of exercise stimulation apparatus 100 includes three position switch 112, power source 114, sensor mechanism 134, signal processor 116, and signal devices such as light indicator or light emitting diode (LED) 118, vibrator 122, sound tone device 124, and electrical stimulator 126. Power source 114 could be a commercially available battery that supplies power to signal processor 116 and the other electrical devices. Tactile switch 135 can use a mechanical, resistive, or capacitive type mechanism, for example, that senses variations in compressive forces acting upon flexible inside cover. The sensitivity of tactile switch 135 is not affected by changes in humidity which enables the apparatus to be used during exercise sessions, outdoors under humid conditions, as well as in an office environment. When switch 134 is compressed it provides an electrical signal to signal processor 116.

Signal processor 116 performs logic, control, and timing operations associated with exercise stimulation apparatus 100. For example, based on the degree of sensor mechanism 134 activation, the response of signal processor 116 then varies in proportion to the degree of abdominal wall relaxation. Upon receiving an initial signal from signal processor 116, light indicator 118, for example, would be turned on dimly, will get progressively brighter, and begin flashing as a maximum response signal. Light indicator 118 is preferably a LED device that could as an alternative change in color from green to amber to red as a function of the user's relaxation of their abdominal muscles.

When activated by signal processor 116, vibrator 122 produces a vibration for the user that can increase in frequency or amplitude as the abdominal muscles are relaxed. Sound tone device 124, when activated by signal processor 116, provides an audible warning that increases with intensity as the pressure is increased and a similar mechanism is provided for electrical stimulator 126. An electrical stimulation capability has the advantage that the electrodes can be remotely attached to the skin and it provides a discrete warning independent of the thickness of the clothing that is worn.

Figure 5:
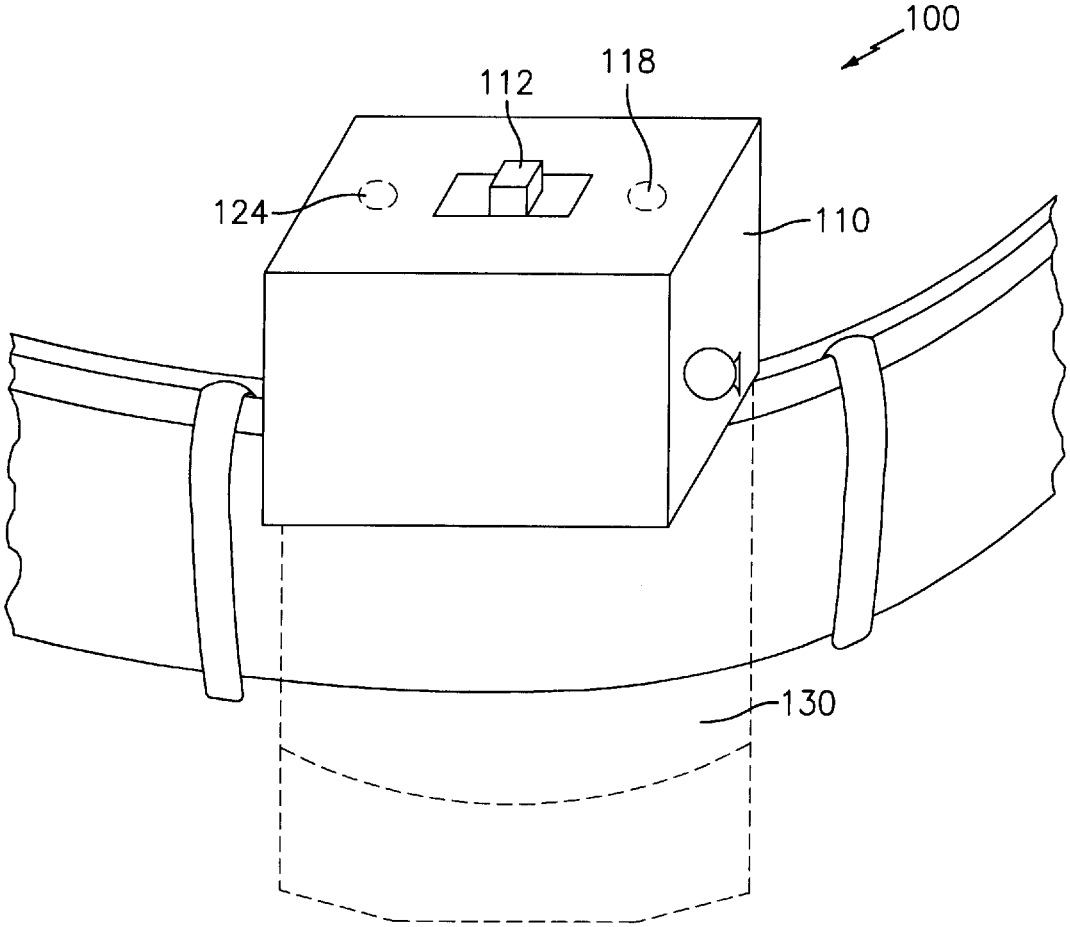
FIG. 5 is a perspective view of the biofeedback exercise stimulation apparatus installed in a waistband.

In FIG. 5 exercise stimulation apparatus 100 is shown positioned in the waistband and against the body of a user with upper section 110 being held above the waistband and the inside of mid section 130 being placed in contact with the user. Exercise stimulation apparatus 100 has the general shape and appearance of a communication beeper and is self-retaining in position as a result of its uniquely novel shape. In an alternative configuration, exercise stimulation apparatus 100 can be positioned inside a belt and against the garment and could contain an LED 118 as a signal device.

Although the illustrative embodiments of the present disclosure have been described herein with reference to the accompanying drawings, it is to be understood that the disclosure is not limited to those precise embodiments, and that various other changes and modifications may be affected therein by one skilled in the art without departing from the scope or spirit of the invention. All such changes and modifications are intended to be included within the scope of the presently disclosed exercise stimulation apparatus 100.

What is claimed is:

1. A biofeedback exercise stimulation apparatus comprising:

a housing having a front side which is oriented to face away from an abdomen of a user when in use and a rear side which is oriented to face toward the user's abdomen when in use;

an upper section including a power source and at least one signal mechanism for signaling the user;

a mid section including a front surface which is configured and dimensioned to be self-retaining when positioned inside a waistband of a user, and a rear surface, the mid section including a sensor mechanism connected with the at least one signal mechanism of the upper section such that the sensor mechanism is actuated by pressure applied by the user's waistband upon expansion of the user's abdomen; and a lower section having a streamlined shape configured for ease of positioning inside the waistband of the user.

2. The biofeedback exercise stimulation apparatus of claim 1, wherein the at least one signal mechanism includes a light.

3. The biofeedback exercise stimulation apparatus of claim 2, wherein the light has at least two different colors.

4. The biofeedback exercise stimulation apparatus of claim 1, wherein the at least one signal mechanism includes a transducer that provides a vibration signal to the user.

5. The biofeedback exercise stimulation apparatus of claim 1, wherein the at least one signal mechanism includes a transducer that provides a sound signal to the user.

6. The biofeedback exercise stimulation apparatus of claim 1, wherein the sensor mechanism is positioned on the front of the mid section.

7. A biofeedback exercise stimulation apparatus comprising:

a housing having a front side which is oriented to face away from an abdomen of a user when in use and a rear side which is oriented to face toward the user's abdomen when in use;

an upper section including a power source and devices for signaling the user;

a mid section having a front side configured and dimensioned for being self-retaining when positioned inside a waistband of a user, the front side of the mid section including a sensor mechanism connected with the devices of the upper section for positioning in apposition with the waistband such that the sensor mechanism is actuated by pressure applied by the user's waistband upon expansion of the user's abdomen; and a lower section configured as a ballast to assist in the retention of the apparatus within the waistband of the user.

8. The biofeedback exercise stimulation apparatus of claim 7, wherein the at least one signal mechanism includes a light.

9. The biofeedback exercise stimulation apparatus of claim 8, wherein the light is a light emitting diode with at least two different colors.

10. The biofeedback exercise stimulation apparatus of claim 7, wherein the at least one signal mechanism includes a transducer that provides a vibration signal to the user.

11. The biofeedback exercise stimulation apparatus of claim 7, wherein the at least one signal mechanism includes a transducer that provides a sound signal to the user.

12. A biofeedback exercise stimulation apparatus for positioning inside a waistband of a person comprising:

a housing having a front side which is oriented to face away from an abdomen of a user when in use, front side being configured and dimensioned to be held in position by a waistband of a user and a rear side configured to fit against the user, the front side including a sensor mechanism connected with at least one signal mechanism and a power source, such that the sensor mechanism is actuated by pressure applied by the user's waistband upon expansion of the user's abdomen.

13. The biofeedback exercise stimulation apparatus of claim 12, wherein the at least one signal mechanism includes a light.

14. The biofeedback exercise stimulation apparatus of claim 13, wherein the light is a light emitting diode with at least two different colors.

15. The biofeedback exercise stimulation apparatus of claim 12, wherein the at least one signal mechanism includes a transducer that provides a vibration signal to the user.

16. The biofeedback exercise stimulation apparatus of claim 12, wherein the at least one signal mechanism includes a transducer that provides a sound signal to the user.

17. The biofeedback exercise stimulation apparatus of claim 12, wherein the sensor mechanism is positioned to be in apposition with the waistband.

18. The biofeedback exercise stimulation apparatus of claim 12, wherein the at least one signal mechanism includes a low voltage electrical stimulation signal connected to the person.

19. The biofeedback exercise stimulation apparatus of claim 12, wherein the apparatus has a mid section with a front side that includes the sensor mechanism.

20. The biofeedback exercise stimulation apparatus of claim 19, wherein the apparatus includes a lower section and a upper section and the dimension between the front side and a rear side of the mid section is less than the dimension between a front side and a rear side of the upper section and the lower section.

* * * * *